US005159007A

United States Patent [19]

Saitoh et al.

[11] Patent Number: 5,159,007

[45] Date of Patent: Oct. 27, 1992

[54] METAL BINDER AND MOLDING COMPOSITIONS

[75] Inventors: Katsuyoshi Saitoh, Kyoto; Tomoaki Hanamura, Ichikawa, both of Japan

[73] Assignee: Idemitsu Petrochemical Co., Ltd., Tokyo, Japan

[21] Appl. No.: 734,900

[22] Filed: Jul. 24, 1991

Related U.S. Application Data

[60] Division of Ser. No. 456,359, Dec. 26, 1989, abandoned, which is a continuation-in-part of Ser. No. 209,695, Jun. 21, 1988, abandoned.

[30] Foreign Application Priority Data

Jun. 25, 1987 [JP] Japan ..... 62-156647

[51] Int. Cl.[5] ..... C08K 3/08

[52] U.S. Cl. ..... 524/439; 524/296; 524/440; 524/441; 524/482

[58] Field of Search ..... 524/296, 439, 440, 441, 524/482

[56] References Cited

U.S. PATENT DOCUMENTS 3,702,314 11/1972 Farjon et al. ..... 524/296
4,041,002 8/1977 Aboshi et al. ..... 524/296

FOREIGN PATENT DOCUMENTS 0296552 12/1988 Fed. Rep. of Germany .
57-149555 9/1982 Japan .

*Primary Examiner*—Paul R. Michl
*Assistant Examiner*—John J. Guarriello
*Attorney, Agent, or Firm*—Hidaka and Benman

[57] ABSTRACT

A metal binder including a base binder agent including a bonding agent, lubricant, etc. into which is blended as a binder auxiliary agent at least one member selected from the group of adamantane, trimethylene norbornane, and cyclododecane and a molding composition including a metal powder made of a metal of Group VIII etc. into which is blended a base binder agent and as a binder auxiliary agent at least one member selected from the group of adamantane, trimethylene norbornane, and cyclododecane.

4 Claims, 1 Drawing Sheet

METAL BINDER AND MOLDING COMPOSITIONS

This is a Division of application Ser. No. 456,359 filed Dec. 26, 1989, abandoned which is a Continuation-in-Part of application Ser. No. 209,695 filed Jun. 21, 1988 abandoned.

BACKGROUND OF THE INVENTION

1. Field of the Invention

The present invention relates to a metal binder effective in the injection molding of products using a metal powder as an ingredient and to a molding composition in which this metal binder is blended.

2. Description of the Related Art

In conventional powder metallurgy wherein powders of various metals (the word "metal" used here also includes an alloy and a sintered hard alloy) are molded and then sintered to produce sintered metal articles, the molding is generally carried out by press molding. However, press molding is not satisfactory for forming complicatedly-shaped objects. Besides, press molding cannot assure a high sintering density and sufficient strength in the succeeding sintering step.

To solve these problems, injection molding has been proposed in the field of metal powder molding and some proposals have actually been put into practice. Injection molding techniques for metal powders are disclosed, for example, in U.S. Pat. Nos. 4,305,756, 4,404,166, 4,415,528, 4,445,936, 4,602,953, and 4,661,315. The injection molding technique can form complicated shapes and can be utilized for the molding of various objects. In addition, this technique has the advantages that the kneading, feeding, and molding of the metal powder and binder are carried out in one process, a high molding accuracy can be attained, and the forming step can be omitted or simplified.

In this connection, it is to be noted that the binders used in the conventional powder metallurgy art include polymeric materials such as ethylene-vinyl acetate copolymer, poly(meta)acrylate, polypropylene, plasticizers such as dibutyl phthalate, and waxes such as paraffin wax. Such binders are used also in the injection molding of the metal powders.

These binders heretofore used, however, have the disadvantages that they are rather difficult to be removed, it takes considerable time for them to be removed, cracking or swelling are liable to occur when debindering, and a high sintering density and high dimensional accuracy are not assured.

Shaped articles formed by injection molding using a conventional binder have a further disadvantage that they cannot retain their shapes due to the fluidity caused by softening of the articles unless debindering and sintering are carried out with the articles placed in the powders.

For these reasons, it is difficult to use injection molding in the field of powder metallurgy, though injection molding is known to be desirable. It is especially difficult, almost impossible, to utilize injection molding for the production of precision sintered articles.

On the other hand, ceramic binders using adamantane and/or trimethylene norbornone as an auxiliary binder agent is known in the field of the preparation of ceramic products (Japanese Patent Application Publication (Kokai) No. 62-3064).

SUMMARY OF THE INVENTION

It is therefore an object of the present invention to provide a metal binder which is capable of being removed rapidly to reduce residue in the molded article and preventing possible occurrence of cracking and swelling in the step of debindering, assuring the quality of the resulting sintered articles, and thereby enabling injection molding to be used practically in the field of powder metallurgy and a molding composition in which the metal binder is blended with material metal powders.

The metal binder of the present invention comprises a base binder agent into which is blended as an auxiliary binder agent at least one member selected from the group consisting of adamantane, trimethylene norbornane, and cyclododecane. In more detail, the metal binder of the present invention is constituted by a base binder agent comprising a bonding agent, lubricant, and, if necessary, a plasticizer and at least one member selected from the group consisting of adamantane, trimethylene norbornane, and cyclododecane.

Likewise, the molding composition of the present invention comprises a metal powder into which is blended a base binder agent and as an auxiliary binder agent at least one member selected from the group consisting of adamantane, trimethylene norbornane, and cyclododecane. Preferably, the metal powder used in the molding composition is powder of a metal of Group VIII, for example, iron, nickel, or cobalt, or another metal or an alloy containing the same (for example, Cr—Ni—C, Fe—Ni).

With this, the debindering time in the production of the metal shaped article can be curtailed and cracking and/or swelling which would otherwise be caused in the debindering can be prevented. In addition, a higher sintering density and high dimensional accuracy are assured to improve the quality of the products, realizing inexpensive provision of precision sintered parts in the field of powder metallurgy.

BRIEF DESCRIPTION OF THE DRAWING

The drawing is a block diagram showing a process for preparing sintered articles by using the metal binder of the present invention.

DESCRIPTION OF THE PREFERRED EMBODIMENTS

Figure 1:
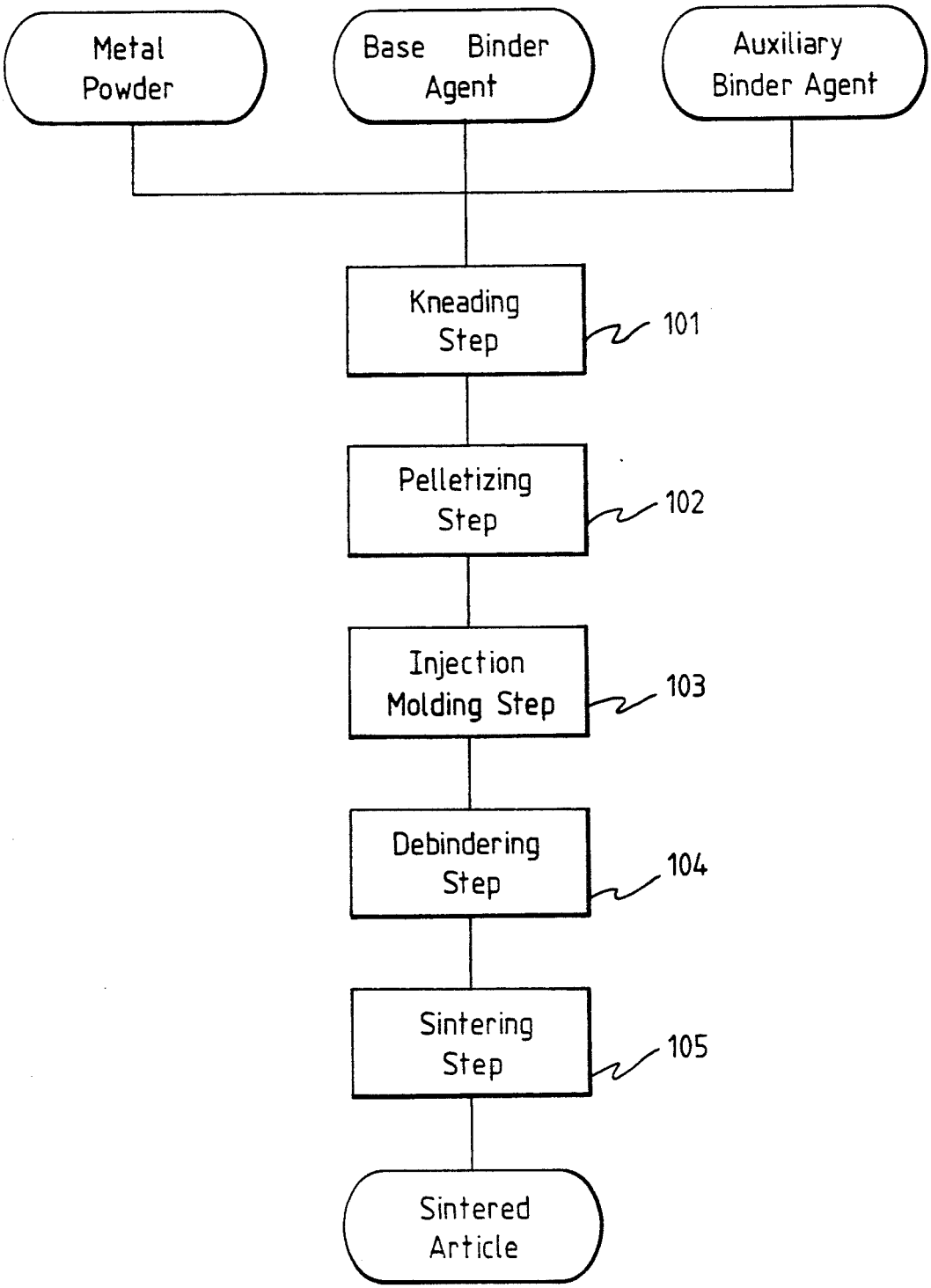

The metal binder of the present invention is constituted by a base binder agent comprising a bonding agent, a lubricant, and, if necessary, a plasticizer and an auxiliary binder agent comprising a sublimable material of at least one member selected from the group consisting of adamantane, trimethylene norbornane, and cyclododecane.

As the bonding agent of the base binder agent, use may be made of an ethylene-vinyl acetate copolymer, natural resin, polyethylene, polypropylene, atatic polypropylene, ethylene-acrylate copolymer, ionomer resin, vinyl chloride resin, vinylidene chloride resin, polystyrene, polybutylmethacrylate, amethylstyrene-methylmethacrylate copolymer, acrylonitrilestyrene resin, acrylonitrile-butadiene-styrene resin, styrenemethylmethacrylate copolymer, vinyl acetate resin, polyvinyl acetal, polyvinyl formal, polyvinyl butyrol, acrylic resin, cellulosic polymer, fluorine resin, phenoxyl resin, polycarbonate, polyamide, polyacetal, polyphenylene oxide, modified polyphenylene oxide, polyethylene terephthalate, polysulfone, polyphenylene sulfide, polyester sulfone, polyimide, or other thermoplastic resin, alginic acid, starch, pulp liquor, methyl cellulose, polyacrylamide, polyvinyl alcohol, and other water-soluble binders.

Among these, ethylene-vinyl acetate copolymer, polyethylene, polystyrene, and cellulosic polymer are preferable as they maintain the strength of the shaped articles, decompose relatively readily, and are easy to convert to a lower molecular weight and remove during debindering.

Further, as the lubricant in the base binder agent, it is possible to use those generally and widely available on the commercial market, for example, stearic acid, liquid paraffin, natural paraffin, microwax, synthetic paraffin wax, polyethylene wax, fluorocarbon oil, higher aliphatic acids, hydroxy aliphatic acids, aliphatic acid amides, bisaliphatic acid amides, lower alcohols of aliphatic acids, hydric alcohol esters of aliphatic acids, Hoechst wax, natural waxes, fatty alcohols, partial esters of aliphatic acids and hydric alcohols, Carnauba wax, etc.

These lubricants are used to improve the moldability and die releasability. Therefore, depending on the type of the metal powder, they may sometimes be omitted.

Further, as the plasticizer of the base binder agent, use may be made of those generally and widely available on the commercial market. For example, mention may be made of dimethyl phthalate, diethyl phthalate, dibutyl phthalate, dihexyl phthalate, dioctyl phthalate, butyl benzyl phthalate, dialkyl phthalic acids with up to 10 carbon atoms, and other phthalic acid plasticizers or dioctyl adipate, dioctyl sebacate, dioctyl azelate, dioctyl maleate, dibutyl maleate, and other dicarbonic acid plasticizers, and also acetyl tributyl citrate, tricresyl phosphate, and other phthalic acid dicarbonic acids. Among these, dibutyl phthalate and other phthalic acid plasticizers are preferable.

Note that these may be used suitably mixed.

The ratio of blending of the bonding agent, lubricant, and plasticizer in 100 parts by weight of the base binder agent differs depending on the type of the metal powder, but usually 10 to 100 parts by weight of the bonding agent, 0 to 70 parts by weight of the lubricant, and, if needed, 0 to 30 parts by weight of the plasticizer are used, preferably 30 to 89 parts by weight of the bonding agent, 10 to 50 parts by weight of the lubricant, and, if necessary, 1 to 20 parts by weight of the plasticizer, more preferably 40 to 65 parts by weight of the bonding agent, 30 to 55 parts by weight of the lubricant, and, if necessary, 5 to 15 parts by weight of the plasticizer.

The metal binder of the present invention comprises such a base binder agent into which is blended as an auxiliary binder agent at least one member selected from the group consisting of adamantane, trimethylene norbornane, and cyclododecane.

The components of the auxiliary binder agent, especially adamantane, are less toxic as compared with the conventional auxiliary binder agents such as naphthalene, camphor, etc. They have another advantage that they rarely produce carbonaceous products through reaction with other materials or self-decomposition. Therefore, contents of carbonaceous impurities in the final products can be reduced. In addition, tinting or coloring and sintering properties can be improved.

Due to the addition of a sublimable substance, at the initial stage of the debinderizing step, the sublimable substance escapes and pre-forms an escape route for the other binder components to escape, so the debindering becomes easy and the debindering time can be shortened.

The adamantane, trimethylene norbornone, and cyclododecane may be used alone or as mixtures. When trimethylene norbornane and/or cyclododecane are mixed with adamantane, the ratio of the trimethylene norbornane and/or cyclododecane to the adamantane is 1:9 or more, preferably 1:9 to 4:1.

Further, the ratio of blending of the above-mentioned base binder agent and the above-mentioned auxiliary binder agent differs depending on the type of the metal powder, but in general is 1 to 100 parts by weight with respect to 100 parts by weight of the base binder agent, preferably 3 to 45 parts by weight, more preferably 9 to 25 parts by weight. The so prepared metal binder may be used in the case of obtaining a sintered product using as ingredients powders of metals such as iron, nickel, copper, stainless steel, etc., powders of alloys of ferrite, or powders or sintered hard alloys (WC, TiC, TaC/Co, Ni, etc.)

The above-mentioned metal powder includes even alloys or sintered hard alloys into which is mixed some ceramic.

Next, a process for preparing sintered articles from metal powders using a metal binder of the present invention will be explained referring to FIG. 1.

Metal powders pulverized mechanically or by plasma, a base binder agent comprising a bonding agent, lubricant, and if necessary a plasticizer, and, as an auxiliary binder agent an adamantane composition are kneaded by a mixer (step 101).

The kneading conditions are, for example, a temperature of 80° to 150° C., preferably 100° to 120° C., and a time of 5 to 3 hours, preferably 0.5 to 1 hour.

The kneading is effected by using a kneader which provides a shearing force while applying heat, such as a Henschel mixer, a Muller mixer, a blast mill, a hot kneader, a ko-kneader, and the like.

The blending procedure may be such that the base binder agent is mixed well with the auxiliary binder agent to prepare the metal binder and the obtained metal binder is then blended with the metal powder or that the metal powder, base binder agent, and auxiliary binder agent are simultaneously or successively blended.

The so kneaded materials are then formed into granules by rolls or formed into pellets by a pelletizer to prepare a molding material (step 102).

The resulting molding material is shaped into a desired shape by slip casting, pressure casting, press molding, jiggering, extrusion molding, a rubber press (CIP), rumming, high temperature press molding, injection molding, a doctor blade (sheet forming), a roller machine, or the like.

The molding material of the present invention is most suitably shaped by the injection molding. The molding material in which the metal binder of the present invention is blended can be molded well by injection under the conditions of a low injection pressure and low injection temperature. Besides, this molding material can curtail the time required for removing the binder after injection molding.

When the injection molding is employed, the molding material is supplied to a plunger type, preplasticizer type, or screw-in-line type injection molding machine to obtain a shaped object by the injection molding (step 103). The injection molding is carried out, for example, at a temperature of 120° to 200° C. under a pressure of 300 to 1500 kg/cm$^2$. The kneaded material of metal powders, base binder agent, and auxiliary binder agent may be supplied to the injection molding machine as it is without being pelletized.

Thereafter the shaped objects are subjected to debinderizing to remove the metal binder (step 104). At this time, it suffices for the shaped objects to be only placed on a stand without being buried in powder. The debinderizing treatment is carried out at a temperature of 20° to 600° C. for 20 to 120 hours, preferably 50 to 100 hours. At an early stage of the debinderizing step, sublimable materials of the auxiliary binder agent are removed, which makes removal of the remaining binder components easier, more uniform, and more rapid. The metal binder of the present invention can be removed more rapidly and more completely as compared with the conventional metal binder to reduce the residue of the binder very much.

The shaped objects are sintered after the debinderizing treatment to obtain sintered articles (step 105).

The debinderizing step (104) and the burning step (105) may be carried out simultaneously.

The molding composition of the present invention will now be described.

The molding composition of the present invention, to achieve the above-mentioned object, comprises a metal powder into which is blended a metal binder constituted by a base binder agent comprising a bonding agent, lubricant, and, when necessary, plasticizer and an auxiliary binding agent comprising at least one sublimable material selected from the group consisting of adamantane, trimethylene norbornane, and cyclododecane.

Preferably, for the metal powder in the molding composition, use is made of powder of a metal of Group VIII, for example, iron, nickel, or cobalt, or another metal or an alloy containing the same (for example, Cr—Ni—C, Fe—Ni).

Further, for the base binder agent and the auxiliary binder agent in the molding composition, use may be made of the same as those comprising the above-mentioned metal binder.

On the other hand, the ratio of blending of the metal binder with respect to the metal powder differs depending on the type of the metal powder, but in general it is 0.1 to 30 parts by weight, preferably 6 to 20 parts by weight, more preferably 8 to 16 parts by weight with respect to 100 parts by weight of the metal powder.

The invention will now be more particuarly described, referring to examples in comparison with comparative examples. In the examples of the present invention, metal powders blended with the metal binders of the present invention were used as materials for forming shaped articles by injection molding.

Table 1 shows formulation of metal powders, base binder agent, and auxiliary binder agent, Table 2 shows conditions of molding, debindering, and sintering, Table 3 shows evaluation of obtained sintered bodies.

The base binder agents and the auxiliary binder agents as listed in Table 1 were charged in amounts as specified in the same table and were kneaded by laboratory blast mill at a temperature of 100°±10° C. for 30 minutes. The torque was 150 kg·cm.

Then, the kneaded materials were broken by a manual press and further subjected to crushing to be formed into bulk materials having a particle size of 5 to 7 mm.

The obtained bulk materials were shaped by an injection molding machine (vertical, plunger type injection molding machine manufactured and sold by Yamashiro Seiki Kabushiki Kaisha) under the conditions as specified in Table 2.

The resulting shaped bodies were subjected to debindering treatment under the conditions as specified in Table 2 and then sintered under the conditions as specified in the same table to obtain sintered metal products.

The evaluation of the appearance, density, and residual carbon amount of the obtained sintered metal products (sintered bodies) is shown in Table 3.

TABLE 1

| | Formulation | | | | | | | | |
|---|---|---|---|---|---|---|---|---|---|
| | | | Base Binder Agent | | | | | | |
| | Metal Powder | | | | | | Total | Aux. Binder Agent | |
| | Kind | Amount (wt) | EVA | Acryl | Wax | DBP | Amount (wt) | Kind ( ) Ratio | Amount (wt) |
| Example | | | | | | | | | |
| 1 | SUS 304L | 100 | 2.76 | 1.85 | 4.62 | 1.20 | 10.43 | Aisour 800 | 1.37 |
| 2 | SUS 304L | 100 | 2.50 | 1.67 | 4.18 | 1.15 | 9.50 | " | 1.24 |
| 3 | SUS 304L | 100 | 2.92 | 2.09 | 3.34 | 1.15 | 9.50 | " | 1.24 |
| 4 | Fe—Ni (2%) | 91 | 2.60 | 2.20 | 2.20 | 1.00 | 8.00 | " | 1.00 |
| Comparative Example | | | | | | | | | |
| 1 | SUS 304L | 100 | 3.70 | 2.77 | 2.76 | 1.27 | 10.50 | None | None |
| 2 | SUS 304L | 100 | 2.76 | 4.62 | 1.85 | 1.27 | 10.50 | " | " |
| 3 | SUS 304L | 100 | 5.53 | 1.85 | 1.85 | 1.27 | 10.50 | " | " |
| 4 | SUS 304L | 100 | 2.76 | 1.85 | 4.62 | 1.27 | 10.50 | " | " |
| | | | PP | Carnauba | | | | | |
| 5 | SUS 304L | 100 | 4.40 | 3.30 | 3.30 | | 11.00 | " | " |
| 6 | Fe—Ni (2%) | 91 | 3.00 | 2.50 | 2.50 | 1.00 | 9.00 | | |

(Notes)
SUS 304L: manufactured by Taiheiyo Kinzoku; Average Particle Size 8.5 μm; Theoretical Density 7.94 g/cm$^3$
Fe—Ni: manufactured by Mitsubishi Metal Corporation; Average Particle Size 12.0 μm; Theoretical Density 7.85 g/cm$^3$
EVA: ethylene-vinyl acetate copolymer
Wax: paraffin wax, mp = 45° C.
Aisour-800: adamantane/trimethylene norbornane (80/20)

TABLE 2

| | Metal Powder | | Molding | | Debindering ($N_2$ gas) | | | Sintering |
|---|---|---|---|---|---|---|---|---|
| | Kind | Amount (wt) | Temp. (°C.) | Pressure (Kgf/cm$^2$) | Temp. (°C.) | Time (Hrs) | Residual Binder (wt %) | Conditions (°C.) |
| Example | | | | | | | | |
| 1 | SUS 304L | 100 | 115 | 660 | 20–500 | 48 | 0.25 | Vacuum ($10^{-4}$ Torr) 500–1350 |
| 2 | SUS 304L | 100 | 145 | " | " | " | 0.20 | Vacuum ($10^{-4}$ Torr) 500–1350 |
| 3 | SUS 304L | 100 | 140 | " | " | " | 0.18 | Vacuum ($10^{-4}$ Torr) 500–1350 |
| 4 | Fe—Ni (2%) | 91 | 140 | " | " | 47 | 2.50 | $NH_3$ gas 300–1200 |
| Comparative Example | | | | | | | | |
| 1 | SUS 304L | 100 | 115 | 660 | 20–500 | 48 | 1.50 | Vacuum ($10^{-4}$ Torr) 500–1350 |
| 2 | SUS 304L | 100 | 170 | " | " | " | 0.80 | Vacuum ($10^{-4}$ Torr) 500–1350 |
| 3 | SUS 304L | 100 | 175 | " | " | " | 2.50 | Vacuum ($10^{-4}$ Torr) 500–1350 |
| 4 | SUS 304L | 100 | 125 | " | " | " | 0.80 | Vacuum ($10^{-4}$ Torr) 500–1350 |
| 5 | SUS 304L | 100 | 165 | " | " | " | 8.00 | Vacuum ($10^{-4}$ Torr) 500–1350 |
| 6 | Fe—Ni (2%) | 91 | 140 | " | " | 47 | 10.00 | $NH_3$ gas 300–1200 |

TABLE 3

| | Metal Powder | | Appearance of Sintered Article (number) | | | | Density of Sintered Article (g/cm$^3$) | | Residual Carbon in Sintered Article | |
|---|---|---|---|---|---|---|---|---|---|---|
| | Kind | Amount (wt) | Normal | Slightly Tilted | Tilted by 90° | Molten | 1300° C. × 2 Hr | 1350° C. × 2 Hr | Vacuum 1300° C. × 2 Hr | Vacuum 1350° C. × 2 Hr |
| Example | | | | | | | | | | |
| 1 | SUS 304L | 100 | 20 | 0 | 0 | 0 | 7.32 | 7.65 | 0.01 or less | 0.01 or less |
| 2 | SUS 304L | 100 | 20 | 0 | 0 | 0 | 7.44 | 7.66 | 0.01 or less | 0.01 or less |
| 3 | SUS 304L | 100 | 20 | 0 | 0 | 0 | 7.64 | 7.71 | 0.01 or less | 0.01 or less |
| 4 | Fe—Ni (2%) | 91 | 20 | 0 | 0 | 0 | $NH_3$ gas 1300° C. × 2 Hr 7.46 | | $NH_3$ gas 1300° C. × 2 Hr 0.01 or less | |
| Comparative Example | | | | | | | | | | |
| 1 | SUS 304L | 100 | 4 | 2 | 14 | 0 | As yields were extremely low and no good sintered articles were obtained, measurements were not carried out. | | | |
| 2 | SUS 304L | 100 | 2 | 18 | 0 | 0 | | | | |
| 3 | SUS 304L | 100 | 0 | 0 | 20 | 0 | | | | |
| 4 | SUS 304L | 100 | 0 | 0 | 20 | 0 | | | | |
| 5 | SUS 304L | 100 | 0 | 0 | 0 | 20 | | | | |
| 6 | Fe—Ni (2%) | 91 | 0 | 10 | 10 | 0 | As deformation was fatal and no good sintered articles were obtained, measurements were not carried out. | | | |

Besides the results as summarized in the table, there were found the following:

(1) When the inside of the obtained sintered metal products were inspected by X-ray photography, no cracks were found in the products obtained according to the examples of the present invention, while some cracks were found in the products of the comparative examples.

(2) Adamantane, trimethylene norbornane, and cyclododecane, at least one of which were used as the auxiliary binder agent, only showed very low toxicity as a sublimable material.

With the molding composition of the present invention in which the metal binder is blended in the metal powders, similar results were obtained.

We claim:

1. A molding composition, comprising:

100 parts by weight of metal powder and 0.1 to 30 parts by weight of a metal binder, said metal binder comprising:

100 parts by weight of a base binder agent comprising 40 to 65 parts by weight of a bonding agent, said bonding agent being a thermoplastic resin, 30 to 55 parts by weight of a lubricant, and 5 to 15 parts by weight of a plasticizer; and 9 to 25 parts by weight of an auxiliary binder agent, with respect to 100 parts by weight of said base binder agent, comprising at least one member selected from the group consisting of adamantane, trimethylene norbornane, and cyclododecane.

2. A molding composition according to claim 1, wherein said thermoplastic resin comprises at least one member selected from the group consisting of ethylene-vinyl acetate copolymer, polystyrene, and polyethylene.

3. A molding composition, comprising:

100 parts by weight of a metal powder and 0.1 to 30 parts by weight of a metal binder, said metal binder comprising:

100 parts by weight of a base binder agent comprising 40 to 65 parts by weight of a bonding agent, 30 to 55 parts by weight of a lubricant, said lubricant being a wax, and 5 to 15 parts by weight of a plasticizer; and 9 to 25 parts by weight of an auxiliary binder agent, with respect to 100 parts by weight of said base binder agent, comprising at least one member selected from the group consisting of adamantane, trimethylene norbornane, and cyclododecane.

4. A molding composition, comprising:

100 parts by weight of a metal powder and 0.1 to 30 parts by weight of a metal binder, said metal binder comprising:

100 parts by weight of a base binder agent comprising 40 to 65 parts by weight of a bonding agent, 30 to 55 parts by weight of a lubricant, and 5 to 15 parts by weight of a plasticizer, said plasticizer being a member selected from the group consisting of a dicarbonic acid ester compound and a phthalic acid dicarbonic acid ester; and 9 to 25 parts by weight of an auxiliary binder agent, with respect to 100 parts by weight of said base binder agent, comprising at least one member selected from the group consisting of adamantane, trimethylene norbornane, and cyclododecane.

* * * * *